US008919680B2

(12) United States Patent
Grether

(10) Patent No.: US 8,919,680 B2
(45) Date of Patent: Dec. 30, 2014

(54) FUNCTIONAL PLUMBING UNIT

(75) Inventor: Hermann Grether, Mullheim (DE)

(73) Assignee: Neoperl GmbH, Mullheim (DE)

( * ) Notice: Subject to any disclaimer, the term of this patent is extended or adjusted under 35 U.S.C. 154(b) by 678 days.

(21) Appl. No.: 13/184,221

(22) Filed: Jul. 15, 2011

(65) Prior Publication Data

US 2011/0266369 A1 Nov. 3, 2011

Related U.S. Application Data

(63) Continuation-in-part of application No. 11/817,602, filed as application No. PCT/EP2006/001837 on Feb. 28, 2006, now abandoned, application No. 13/184,221, which is a continuation-in-part of application No. 10/529,968, filed as application No. PCT/EP03/08842 on Aug. 8, 2003.

(30) Foreign Application Priority Data

| | | |
|---|---|---|
| Oct. 22, 2002 | (DE) | 102 49 340 |
| Nov. 5, 2002 | (DE) | 202 17 031 U |
| Mar. 4, 2005 | (DE) | 10 2005 010 551 |

(51) Int. Cl.

| | |
|---|---|
| ***B05B 1/00*** | (2006.01) |
| ***E03C 1/08*** | (2006.01) |
| ***B05B 1/14*** | (2006.01) |
| ***E03C 1/084*** | (2006.01) |

(52) U.S. Cl.

CPC ..... *E03C 1/084* (2013.01)
USPC ..... 239/600; 239/428.5; 239/553; 239/553.3; 239/590; 239/590.3

(58) Field of Classification Search

CPC ..... E03C 1/08; E03C 1/084; E03C 1/086; B05B 7/0425
USPC ..... 239/428.5, 432, 553, 553.3, 553.5, 590, 239/590.3, 590.5, 596, 600
See application file for complete search history.

(56) References Cited

U.S. PATENT DOCUMENTS

| | | | |
|---|---|---|---|
| 2,954,936 | A | 10/1960 | Shames et al. |
| 2,989,249 | A | 6/1961 | Richter |
| 3,110,445 | A | 11/1963 | Benjamin et al. |
| 3,223,045 | A | 12/1965 | Shope |
| 3,227,380 | A | 1/1966 | Pinkston |

(Continued)

FOREIGN PATENT DOCUMENTS

| | | |
|---|---|---|
| CH | 380 042 | 8/1964 |
| DE | 1 910 493 | 2/1965 |

(Continued)

*Primary Examiner* — Ryan Reis
(74) *Attorney, Agent, or Firm* — Volpe and Koenig, P.C.

(57) ABSTRACT

A functional plumbing unit is provided, which is configured as an insertion cartridge insertable into a fluid conduit of a discharging plumbing fixture. The insertion cartridge includes a housing and a jet regulator. The housing includes an external thread on an outside thereof, configured to be screwed into an internal thread of the discharging plumbing fixture, a height of the housing, in a flow direction, generally corresponds to the external thread, a ring seal located in a downstream position therefrom and an upstream housing edge, the external thread is arranged between the downstream ring seal and the upstream housing edge, and at least a jet fractionating part, is arranged at an inlet end configured to be connected to the housing.

10 Claims, 1 Drawing Sheet

(56) References Cited

U.S. PATENT DOCUMENTS

| | | | | | |
|---|---|---|---|---|---|
| 3,286,935 | A | | 11/1966 | Corlett et al. | |
| 3,291,064 | A | | 12/1966 | Foster | |
| 3,298,614 | A | * | 1/1967 | Aghnides | 239/428.5 |
| 3,635,405 | A | | 1/1972 | Shames et al. | |
| 3,682,392 | A | | 8/1972 | Kint | |
| 3,684,191 | A | | 8/1972 | Shames et al. | |
| 3,827,636 | A | | 8/1974 | Parkison et al. | |
| 4,320,541 | A | | 3/1982 | Neenan | |
| 4,365,755 | A | | 12/1982 | Aghnides | |
| 4,403,739 | A | | 9/1983 | Knapp et al. | |
| 4,470,546 | A | | 9/1984 | Wildfang | |
| 4,530,467 | A | | 7/1985 | Bueno | |
| 4,534,513 | A | * | 8/1985 | Aghnides | 239/428.5 |
| 4,534,514 | A | * | 8/1985 | Aghnides | 239/428.5 |
| 4,562,960 | A | | 1/1986 | Marty et al. | |
| 4,637,552 | A | | 1/1987 | Finkbeiner et al. | |
| 4,722,509 | A | | 2/1988 | Delker et al. | |
| 4,730,786 | A | | 3/1988 | Nelson et al. | |
| 4,941,492 | A | | 7/1990 | Morgan | |
| 5,071,071 | A | | 12/1991 | Chao | |
| 5,467,929 | A | * | 11/1995 | Bosio | 239/428.5 |
| 5,495,985 | A | | 3/1996 | Nehm et al. | |
| 5,769,326 | A | | 6/1998 | Muchenberger et al. | |
| 5,803,368 | A | | 9/1998 | Shekalim | |
| 5,943,711 | A | | 8/1999 | Loizeaux et al. | |
| 6,029,912 | A | | 2/2000 | Woolley | |
| 6,126,093 | A | * | 10/2000 | Grether et al. | 239/428.5 |
| 6,152,182 | A | * | 11/2000 | Grether et al. | 138/42 |
| 6,249,921 | B1 | | 6/2001 | Daniel et al. | |
| 6,409,100 | B1 | | 6/2002 | Lundberg | |
| 6,513,731 | B2 | | 2/2003 | Griffin et al. | |
| 2002/0079471 | A1 | | 6/2002 | Shen | |
| 2002/0084353 | A1 | | 7/2002 | Griffin et al. | |

FOREIGN PATENT DOCUMENTS

| | | |
|---|---|---|
| DE | 35 09 666 | 9/1986 |
| DE | 38 35 143 | 4/1990 |
| DE | 40 39 337 | 7/1991 |
| DE | 198 05 691 | 8/1999 |
| DE | 198 51 151 | 5/2000 |
| FR | 2 576 939 | 8/1986 |
| WO | 2004/033807 | 4/2004 |
| WO | 2004/038112 | 5/2004 |

* cited by examiner

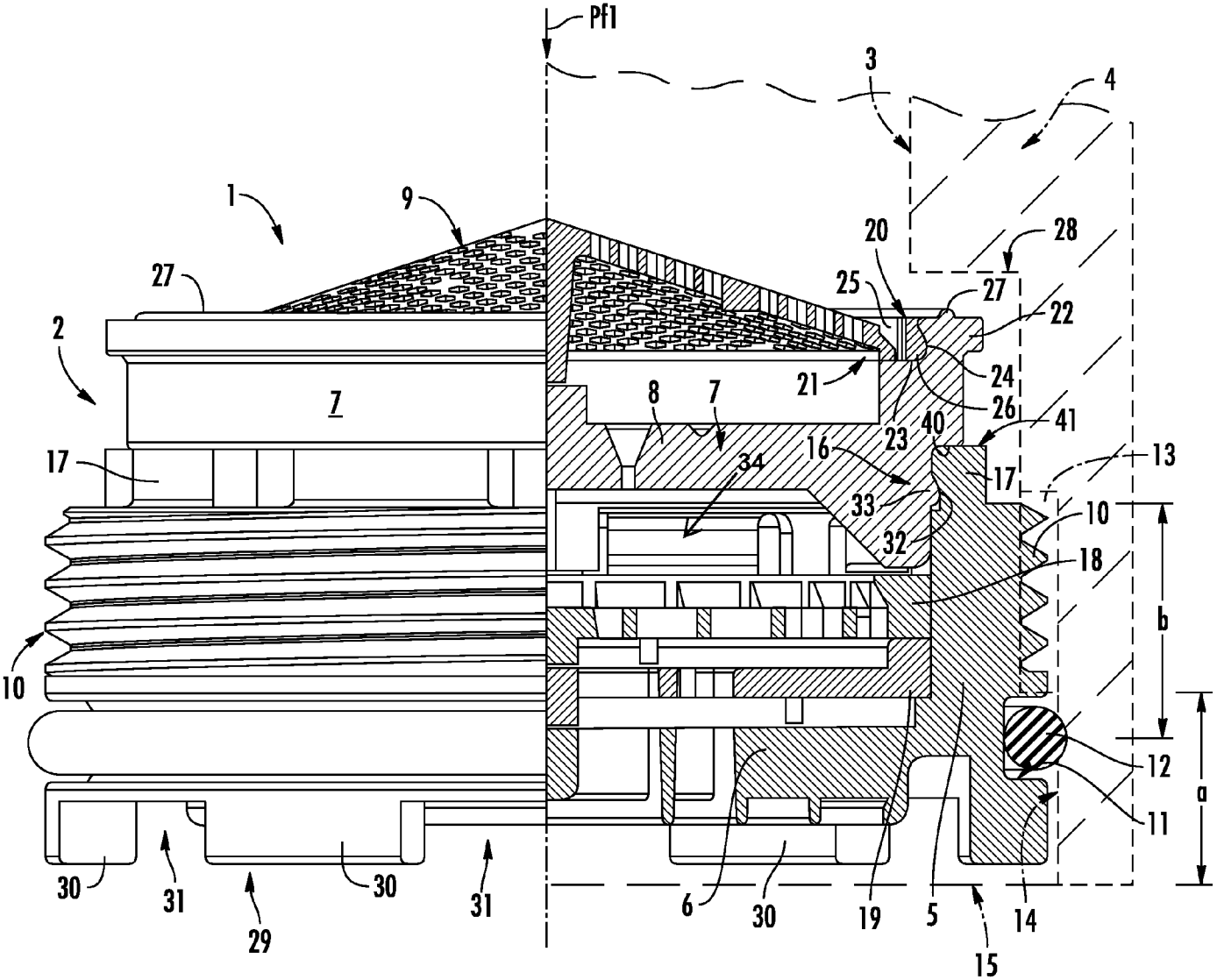
a
b
1
2
3
4
5
6
7
8
9
10
11
12
13
14
15
16
17
18
19
20
21
22
23
24
25
26
27
28
29
30
31
32
33
34
40
41
Pf1

FUNCTIONAL PLUMBING UNIT

CROSS-REFERENCE TO RELATED APPLICATIONS

This application is a Continuation-in-Part of U.S. patent application Ser. No. 11/817,602, filed Aug. 31, 2007, which is a §371 U.S. National Phase application of International Application No. PCT/EP06/01837, filed Feb. 28, 2006, and which also claims benefit of U.S. patent application Ser. No. 10/529,968, filed Mar. 31, 2005, which in turn is a §371 U.S. National Phase application of International Application No. PCT/EP2003/008842, filed Aug. 8, 2003, the entire contents of all of which are incorporated by reference as if fully set forth.

BACKGROUND

The invention relates to a functional plumbing unit, which is embodied as an insertion cartridge which can be inserted into a liquid conduit of a discharging plumbing fixture and a housing, a jet regulator, as well as an attachment screen located at the inlet end wherein the housing includes an external thread on an external surface thereof that is screwable into an internal thread of the plumbing fixture.

SUMMARY

The present disclosure is directed to a functional plumbing unit, which is configured as an insertion cartridge insertable into a fluid conduit of a discharging plumbing fixture. The insertion cartridge includes a housing and a jet regulator. The housing includes an external thread on an outside thereof, configured to be screwed into an internal thread of the discharging plumbing fixture, a height of the housing, in a flow direction, generally corresponds to the external thread, a ring seal located in a downstream position therefrom and an upstream housing edge, the external thread is arranged between the downstream ring seal and the upstream housing edge, and at least a jet fractionating part, is arranged at an inlet end configured to be connected to the housing.

BRIEF DESCRIPTION OF THE DRAWING

The single FIGURE, which is shown to scale, shows:

a cross-section of a functional plumbing unit provided as an insertion cartridge.

DETAILED DESCRIPTION OF THE PREFERRED EMBODIMENT

Introduction to the Embodiments

The object is to provide a functional plumbing unit embodied as an insertion part of the type noted at the outset which can be produced in a cost-effective and easy fashion and is functionally safe.

This object is attained according to the invention in particular in that the length of the housing is essentially dimensioned to accommodate the external thread and the subsequent ring seal, and that a jet fractionating part is arranged at the inlet end that can be connected to the housing.

The functional unit according to the invention therefore essentially comprises only two primary components, which can be produced in a relatively simple manner, namely the housing and the jet fractionating part, which are connected to each other and then form the jet regulator.

Another suggested solution with an importance by itself worth protecting provides that a perforated plate is formed in one piece at the outlet end of the housing. The functional unit embodied according to this solution is provided at its housing, which can be screwed into the discharging plumbing fixture, with a perforated plate formed in one piece at the outlet end, which serves as a protection from vandalism to effectively prevent any unauthorized pushing up of the parts located inside the housing leading to leaks.

Here, a further development according to the invention, in itself worth protecting, provides that the jet fractionating part and the housing each engage with a partial section of their longitudinal extension in the operational position and that at the jet fractionating part or the housing at the external or internal perimeter, a circular stop is provided, which in the operational position impinges the facing edge region of the respective other component. In this further developed embodiment, the jet fractionating part and the housing each engage in the operational position only with a partial section of their longitudinal extension. By this sectional engagement of these components, a horizontal separation level develops between the jet fractionating part and the housing; due to the fact that these parts impinge each other not in the direction of the flow but in a horizontal separation plane any potential leaks are counteracted without any additional O-ring or a similar ring seal being necessary. An increased sealing effect even without any additional ring seal between the jet fractionating part and the housing is promoted even further by a circular stop being provided at the perimeter of the jet fractionating part or the housing, which impinges in the operational state the facing edge region of the respective other part. Therefore no complex sealing of the jet fractionating part is necessary. In case that water passes the jet fractionating part, the leaking water flows into the normal water jet and is not perceived as disturbing by the user by it worsening the jet. Furthermore, such an embodiment has considerably fewer parts and a highly compact design. Further, the lower structural height offers considerably more design freedom for the design of the fixture.

Here, it is particularly advantageous when at the jet fractionating part, a circular stop is provided preferably at the external perimeter which in the operational position impinges the inlet end of the facing edge area of the housing.

It is advantageous when the housing as well as the jet fractionating part that can be connected thereto are each provided with a preferably encircling snapping formation, which engage each other in the assembled position. The two parts can therefore be easily snapped together, and be separated again from each other, if necessary. Due to the holding elements provided in one piece directly at the parts to be connected, no additional parts are necessary for the connection, which facilitates the design of the functional unit and also promotes such a short structural length.

The external thread provided at the housing part as well as the ring seal allow the direct installation in the liquid conduit of a discharging plumbing fixture without an adapter being necessary provided with the parts external thread/ring seal holding the parts together. This facilitates production and assembly.

The ability to separate the housing parts and the jet fractionating parts is particularly advantageous when the functional features of the jet regulator shall be changed. In the housing, between the perforated plate of the housing, preferably embodied as a honey-comb shaped plate, and the perforated plate of the jet fractionating part a intermediate space is provided, in spite of the low overall structural length, to accept one or more screen-like attachments.

The sizing of the length of the housing such that there is space for the external thread and the preferably directly adjacent ring seal, with the housing edge practically immediately following the external thread at the inlet end, a very compact design develops, by which then the functional unit can also be inserted in discharging plumbing fixtures, which for example for design reasons offer little space for accepting the functional unit. This way, compact functional units can be realized with an overall height of the insertion cartridge including the attachment screen amounting to approximately 1.5 cm.

Advantageously, the internal thread of the discharging plumbing fixture has a distance from its mouth smaller than a distance of the housing ring seal from the internal end of the external tread of the housing.

This way, the threaded connection already engages during the assembly of the functional unit, before the ring seal enters the discharge plumbing fixture so that in particular a manual assembly process is considerably facilitated. On the other hand, during the assembly the ring seal can be moved out of the seat in the fixture by rotating the functional unit in the axial direction until it is no longer engaged and before the threaded connection is disengaged.

This facilitated assembly and disassembly is particularly important because the insertion cartridge is arranged as a "hidden inserted cartridge" with at least the overwhelming portion of its longitudinal extension, preferably its entire longitudinal extension, inside the discharging plumbing fixture.

Beneficially the jet fractionating part is provided at the inlet end with an insertion opening for the attachment screen with an external circular wall and a support stop, with the holding elements for fastening the attachment screen being embodied as snapping elements and with, for this purpose, an external circular wall being provided at the inside with an undercut and the external edge of the attachment screen being preferably provided with an encircling snapping protrusion engaging the undercut.

The attachment screen can therefore be snapped at the top of the jet fractionating part and thus is held securely. This contributes to low production and assembly expenses because on the one hand the holding elements are formed at the parts to be connected during their production and on the other hand the assembly of the screen can occur quickly in a manual or automatic fashion.

An additional security of the snapped-on attachment screen can occur during the assembly in the discharging plumbing fixture. For this purpose, the inlet side of the circular wall of the jet fractionating part and at least a section of the external edge of the attachment screen form a stop contacting an insertion stop in the discharging plumbing fixture in the assembled position. Here, the insertion stop of the discharging plumbing fixture cover partially or entirely the edge of the screen so that the attachment screen is securely held even under disadvantageous conditions.

In order to additionally facilitate the production of the functional unit according to the invention and to reduce the number of parts necessary it is advantageous for the housing to be produced in one piece with a perforated plate at the outlet end as a part of the jet regulator.

A preferred further embodiment of the invention provides for the jet fractionating part being connected in one piece to an additional perforated plate arranged as a part of the jet regulator and/or that the jet fractionating part is provided with holding elements to fasten the attachment screen.

Additional features of the invention are discernible from the following description of exemplary embodiment according to the invention in connection with the claims and the drawing. The individual features can each by themselves or combined be implemented in an embodiment according to the invention.

DETAILED DESCRIPTION

A functional plumbing unit 1 is shown in the FIGURE as an insertion cartridge 2, which can be inserted into a liquid conduit 3 of a discharging plumbing fixture 4 indicated only at one side in a dot-dash line.

The functional unit 1 is essentially provided with a housing 5 having a perforated plate 6 embodied in one piece therewith at the outlet end, a jet fractionating part 7 with a perforated plate 8 in one piece, as well as an attachment screen 9. The perforated plate 6 formed in one piece at the housing 5 at the outlet end also serves as protection from vandalism which effectively prevents an unauthorized pushing up of the parts located inside the interior of the housing 5, leading to leaks.

The housing 5 has at the outer periphery an external thread 10 and downstream adjacent thereto a ring seal 12 inserted into a circular groove 11. The flow direction is indicated by the arrow Pf 1. With the external thread 10, the housing 5 can be screwed into an internal thread 13 of the discharging plumbing fixture 4 and is sealed via the ring seal 12 against the internal wall 14 of the discharging plumbing fixture 4. It is clearly discernible here, that the internal thread of the discharging plumbing fixture 4 is recessed inwardly so that the ring seal 12 contacts at a thread-free section. In order to facilitate the assembly and also the disassembly of the insertion cartridge 2 into the discharging plumbing fixture 4 the internal tread 13 of the discharging plumbing fixture 4, on the one hand, and the ring seal 12 of the housing 5, on the other hand, are arranged such that the threads already engage when the ring seal 12 is still outside the mouth of the discharging plumbing fixture 15. This is achieved by the internal threads 13 of the discharging plumbing fixture 4 having a distance a from the mouth 15, which is shorter than the distance b of the housing ring seal 12 from the internal end of the external thread 10 of the housing. This causes the threads to remain engaged when the insertion cartridge 2 is screwed out of the discharging plumbing fixture 4 until the ring seal 12 exits or has left the mouth 15.

In order to avoid leaks in the area between the jet fractionating part 7 and the housing 5 the jet fractionating part 7 and the housing 5, each engage in the operational position with a partial section of their longitudinal extension. Here, at the jet fractionating part 7 or the housing 5, a circular stop 40 is provided at the internal and/or external perimeter which in the operational position impinges the facing edge region 41 of the respectively other part 57. From the FIGURE it is discernible that here the jet fractionating part 7 carries the circular stop 40 in the operational position impinging the inlet end of the facing edge region 41 of the housing 5. Here, the jet fractionating part 7 is connected to the housing 5 via a snap connection 16.

The snap connection 16 is provided at the edge 17 of the housing, which is immediately adjacent to the external thread 10 of the housing 5. For this snap connection the housing edge 17 is provided with a circular groove 32 at the inside, while the jet fractionating part 7 has a circular bead 33 engaging the circular groove. Both snapping forms are preferably embodied in an encircling fashion.

The snap connection 16 provided is embodied such that the jet fractionating part 7 can be separated from the housing 5 and then the interior space of the housing is accessible.

The attachment screen 9 is also connected to the jet fractionating part 7 via a snap connection 20. This jet fractionating part 7 is provided at the top and/or at the inlet end with an insert opening 21 having an external circular wall 22 and a support stop 23. The circular wall 22 has at the interior side an undercut 24 and the external edge 25 of the attachment screen 9 has a particularly encircling snapping protrusion 26 engaging the undercut 24. The attachment screen 9 can therefore be snapped into the insert opening 21 of the jet fractionating part 7 from the inlet side and is therefore securely connected to the jet fractionating part 7.

Due to the fact that the parts of the insertion cartridge 2 to be connected with each other, thus the housing 5, the jet fractionating part 7, and the attachment screen 9 themselves provide the connection elements in one piece, they can be connected to each other without requiring any additional holders.

The housing 5 of the insertion cartridge 2 can be provided with a profiled external perimeter and/or a profiled end at the outlet side to contact an assembly tool. In the exemplary embodiment, at the outlet end, a profiled circular edge 29 is provided at which an assembly tool can be contacted to screw in and out the insertion cartridge 2. It is particularly advantageous when this profiling of the circular edge is embodied such that another insertion cartridge 2 can be used as the assembly tool in the upside-down position and can engage with the profiling of its circular edge the insertion cartridge 2 to be screwed in and out. For this purpose the circular edge 29 is provided in the exemplary embodiment with a circular wall section 30 having interruption 31 located therebetween. The interruptions 31 are sized in the circumferential direction such that the circular wall sections 30 fit into an identically embodied other insertion cartridge 2. Instead of this profiling differently embodied profiling can also be provided.

The invention claimed is:

1. An insertion cartridge, configured for insertion into a fluid conduit of a discharging plumbing fixture, comprising a housing, with an external thread having a height on an outside thereof, which is matingly engageable with an internal thread of the discharging plumbing fixture, a height of the housing substantially corresponds to the height of the external thread and a ring seal located in a downstream position therefrom, the external thread is directly connected to an upstream housing wall, and at least a jet fractionating part, comprising a plurality of axial openings in a flow direction, is immediately adjacent and directly connected to and extends beyond the housing at the upstream housing wall, wherein the housing includes a perforated plate formed in one piece with the housing on an outlet end thereof, wherein the insertion cartridge is provided with a profiled circular end face at an outlet end thereof and wherein a second insertion cartridge is used as an assembly tool for the insertion cartridge to be inserted or disassembled, that engages with the profiled circular end face of the insertion cartridge.

2. The functional plumbing unit according to claim 1, wherein in an operational position the jet fractionating part and the housing engage each other with a partial section of a longitudinal extension thereof, and a circular stop is provided at a perimeter of the jet fractionating part or the housing which in the operational position impinges a facing edge region of the other of the housing or the jet fractionating part.

3. The functional plumbing unit according to claim 1, wherein on the housing at the inlet end, the housing edge is adjacent to the ring seal and the adjacent external thread.

4. The functional plumbing unit according to claim 1, wherein an overall height of the insertion cartridge in the flow direction is approximately 1.5 cm.

5. The functional plumbing unit according to claim 1, wherein the housing and the jet fractionating part connected thereto are each provided with an encircling snapping element and engage one another in an assembled position.

6. The functional plumbing unit according to claim 1, wherein a space for accepting one or more grill-shaped attachments is provided in the housing between the perforated plate of the housing, which is embodied as a honeycomb shaped plate, and a perforated plate of the jet fractionating part.

7. The functional plumbing unit according to claim 1, wherein the jet fractionating part is provided at the inlet end with an insert opening for an attachment screen having an external circular wall and a support stop, and holding elements to fasten the attachment screen are embodied as snap elements, comprising the external circular wall is provided at an interior thereof with an undercut and an external edge of the attachment screen is provided with an encircling, snapping protrusion that engages the undercut.

8. The functional plumbing unit according to claim 7, wherein the inlet end of the circular wall of the jet fractionating part and at least a section of the external edge of the attachment screen form a stop that contacts an insertion stop in the discharging fixture in an assembled position.

9. The functional plumbing unit according to claim 1, wherein the jet fractionating part is provided connected in one piece to another perforated plate as a part of the jet regulator.

10. The functional plumbing unit according to claim 1, wherein the jet fractionating part is provided with holding elements for fastening an attachment screen.

* * * * *